US006769405B2

(12) United States Patent
Leman et al.

(10) Patent No.: US 6,769,405 B2
(45) Date of Patent: Aug. 3, 2004

(54) ENGINE WITH HIGH EFFICIENCY HYDRAULIC SYSTEM HAVING VARIABLE TIMING VALVE ACTUATION

(75) Inventors: Scott A. Leman, Eureka, IL (US); Ronald D. Shinogle, Peoria, IL (US); Scott F. Shafer, Morton, IL (US)

(73) Assignee: Caterpillar Inc, Peoria, IL (US)

( * ) Notice: Subject to any disclaimer, the term of this patent is extended or adjusted under 35 U.S.C. 154(b) by 78 days.

(21) Appl. No.: 10/209,029

(22) Filed: Jul. 31, 2002

(65) Prior Publication Data

US 2004/0020467 A1 Feb. 5, 2004

(51) Int. Cl.[7] ..... F02M 37/04; F02M 57/04
(52) U.S. Cl. ..... 123/446; 123/90.12; 123/90.13
(58) Field of Search ..... 123/446, 447, 123/90.12, 90.13

(56) References Cited

U.S. PATENT DOCUMENTS

| | | | | |
|---|---|---|---|---|
| 4,572,114 A | | 2/1986 | Sickler | |
| 4,592,319 A | | 6/1986 | Meistrick | |
| 5,537,976 A | | 7/1996 | Hu | |
| 5,540,203 A | * | 7/1996 | Foulkes et al. | 123/446 |
| 5,669,355 A | | 9/1997 | Gibson et al. | |
| 5,680,841 A | | 10/1997 | Hu | |
| 5,687,693 A | | 11/1997 | Chen et al. | |
| 5,746,175 A | | 5/1998 | Hu | |
| 5,934,245 A | | 8/1999 | Miller et al. | |
| 5,957,106 A | | 9/1999 | Maloney et al. | |
| 5,996,550 A | | 12/1999 | Israel et al. | |
| 6,085,705 A | | 7/2000 | Vorih | |
| 6,112,710 A | | 9/2000 | Egan, III et al. | |
| 6,125,828 A | | 10/2000 | Hu | |
| 6,257,183 B1 | | 7/2001 | Vorih et al. | |
| 6,474,295 B2 | * | 11/2002 | Milam | 123/446 |
| 6,484,696 B2 | * | 11/2002 | Barnes et al. | 123/446 |
| 2002/0023625 A1 | * | 2/2002 | Sturman | 123/446 |

OTHER PUBLICATIONS

Bernd Mahr, Manfred Dürnholz, Wilhelm Polach, and Hermann Grieshaber, RObert Bosch GmbH, Heavy Duty Diesel Engines—The Potential of Injection Rate Shaping for Optimizing Emissions and Fuel Consumption Stuttgart, Germany, at the 21st International Engine Symposium, May 4–5, 2000, Vienna, Austria.

Ricardo, Inc., Ricardo Automatic Valve Control (AVC), Ricardo, Inc., Published 2001, pp. 1–16.

* cited by examiner

*Primary Examiner*—Thomas N. Moulis
(74) *Attorney, Agent, or Firm*—Liell & McNeil

(57) ABSTRACT

A hydraulic system comprises a pump, low pressure drain, high pressure rail, fuel injector, a gas exchange valve actuator, and a timing valve. The high pressure rail is connected to the pump with a supply line. A method of operating an engine comprises the steps of opening a gas exchange valve by connecting it with the outlet of the pump at a first chosen time, supplying pressurized fluid to a high pressure rail by connecting it with the outlet of the pump after the first time, and injecting fuel by supplying fluid from the high pressure rail to a fuel injector at a second chosen time. An engine comprises an engine casing that defines a plurality of cylinders. A fuel injector, gas exchange valve actuator, pump, supply line, and timing valve is provided for each of the cylinders. A low pressure drain and a high pressure rail are also provided.

20 Claims, 5 Drawing Sheets

ENGINE WITH HIGH EFFICIENCY HYDRAULIC SYSTEM HAVING VARIABLE TIMING VALVE ACTUATION

TECHNICAL FIELD

The present invention relates generally to engine hydraulic systems used for fuel injection and exhaust/intake valve actuation, and in particular to such systems having variable timing valve actuation.

BACKGROUND

Engineers are always searching for ways to improve the efficiency and performance of internal combustion engines. In many internal combustion engines, gas exchange valves and the fuel injection system are driven with a rotating cam coupled directly to the engine crankshaft, necessarily linking the timing and duration of fuel injection and gas exchange to engine speed and crank angle. However, engineers have recognized that combustion efficiency and overall engine performance can be improved by de-coupling this linkage of the fuel injection system from the rotation angle of the crankshaft.

Caterpillar, Inc. of Peoria, Ill. has seen considerable success by incorporating hydraulically-actuated electronically-controlled fuel injectors into engines. In such engines, an engine computer is used to control injection of a calculated amount of fuel into the combustion space in a timing scheme based upon sensed operating conditions and other parameters. Caterpillar, Inc. has also developed an engine in which the timing and duration of both fuel injection and gas exchange valve actuation are de-coupled from the engine crank angle. An example of this engine can be found in U.S. Pat. No. 5,957,106 issued to Maloney et at. on Sep. 28, 1999. The Maloney engine utilizes a gas exchange valve integrated with a fuel injector in which the fuel injection mechanism is housed partially within the gas exchange valve member. Because both fuel injection and gas exchange are electronically controlled, actuation of both subsystems can be accomplished independent of the position of the engine's crank shaft.

While this innovative design has promise, the merger of gas exchange actuators with fuel injector structure is relatively complex. Additionally, the gas exchange valve member is limited to moving between two positions, reducing the desirability of the design for applications in which multiple valve positions are desired. Furthermore, the hydraulic force provided for valve actuation may need modification to open the valve against the gas pressure in the cylinder when the piston nears its top dead center position to perform compression release braking. Due to this issue, Maloney may need design changes to be better suited for engine compression release braking, in which the valves must be quickly opened and closed against substantial pressure in the cylinder. The present invention is directed to solving one or more of the problems set forth above.

SUMMARY OF THE INVENTION

In one aspect, a hydraulic system is provided which includes a pump with an outlet, a low pressure drain, a high pressure rail, and a fuel injector fluidly connected to the high pressure rail. A gas exchange valve actuator is also provided, and a timing valve which has an off position and an on position. In the timing valve's off position, the outlet of the pump is fluidly connected to the low pressure drain. In its on position, the pump outlet is fluidly connected to the gas exchange valve actuator. A supply line is also provided which fluidly connects the output of the pump to the high pressure rail.

In another aspect, the present invention includes a method of operating an engine. The method includes a step of opening a gas exchange valve at least in part by fluidly connecting a gas exchange valve actuator to an outlet of a pump at a first time. The method also includes the step of supplying fluid to a high pressure rail at least in part by fluidly connecting the outlet of the pump to the high pressure rail after the gas exchange valve is opened. The method further includes the step of injecting fuel at least in part by supplying fluid to a fuel injector from the high pressure rail at a second time.

In still another aspect, the present invention includes an engine comprised of an engine casing defining a plurality of cylinders. Attached to the engine casing is a fuel injector, at least one gas exchange valve actuator, a pump, a supply line, and a timing valve for each of the plurality of cylinders. A low pressure drain and high pressure rail are also provided. Each timing valve has an off position in which an outlet of the pump is fluidly connected to the low pressure drain, and an on position in which the outlet is fluidly connected to the gas exchange valve actuator.

DETAILED DESCRIPTION

Figure 1:
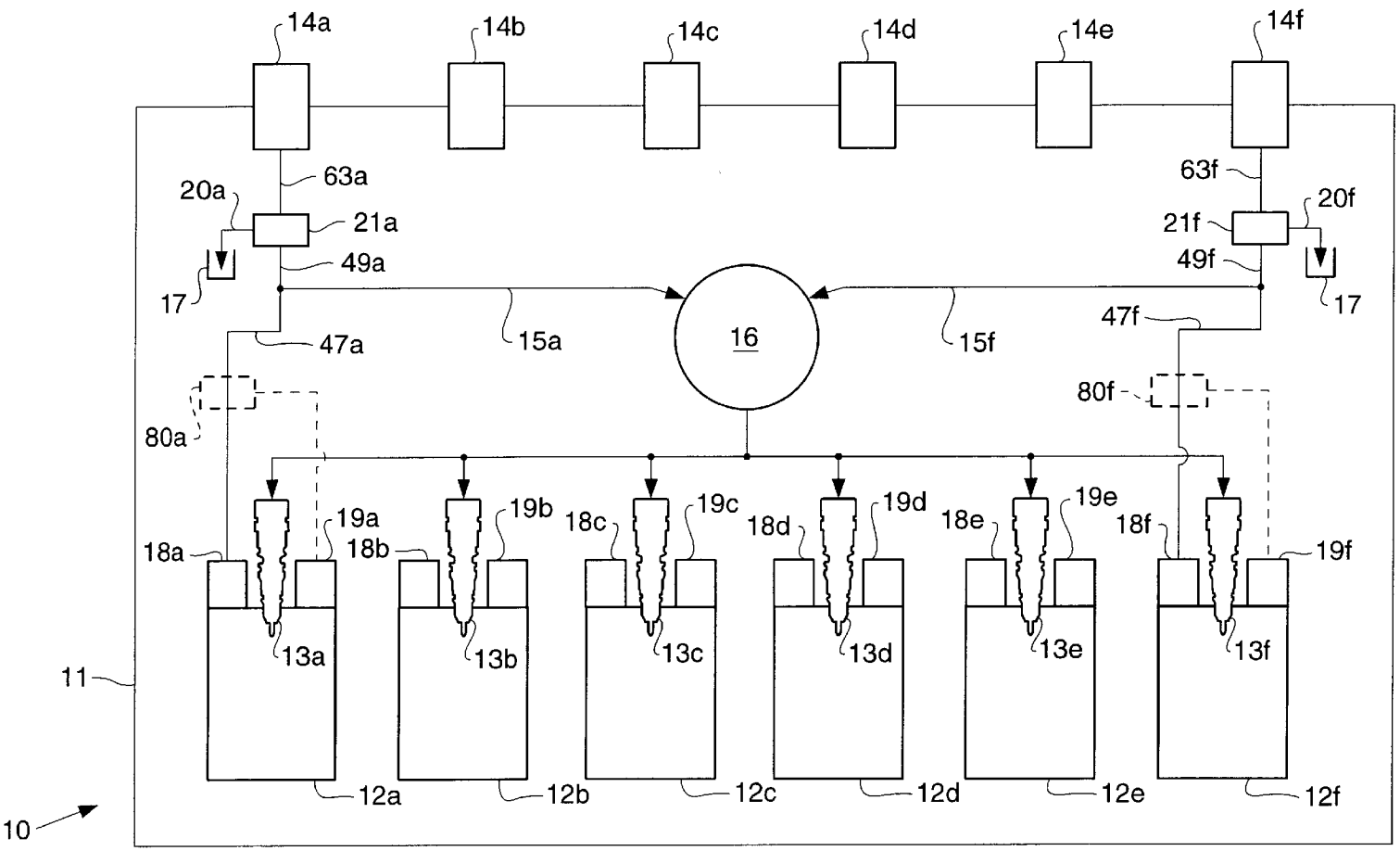
FIG. 1 is a system level diagrammatic representation of an engine according to the present invention.

Referring to FIG. 1, there is shown a diagrammatic representation of an engine 10 according to the present invention. Engine 10 includes an engine casing 11 which defines a plurality of cylinders 12*a–f*. A plurality of pumps 14*a–f*, a plurality of exhaust valves 18*a–f*, and a plurality of intake valves 19*a–f* are provided which are attached to casing 11. The plurality of exhaust valves 18*a–f* and intake valves 19*a–f* are preferably positioned such that they may open or close each cylinder 12*a–f* for gas intake, gas exhaust, or engine compression release braking, depending on the desired application. A plurality of fuel injectors 13*a–f* which are preferably hydraulically actuated fuel injectors are also attached to casing 11, and preferably positioned at least partially within cylinders 12*a–f*.

Figure 2:
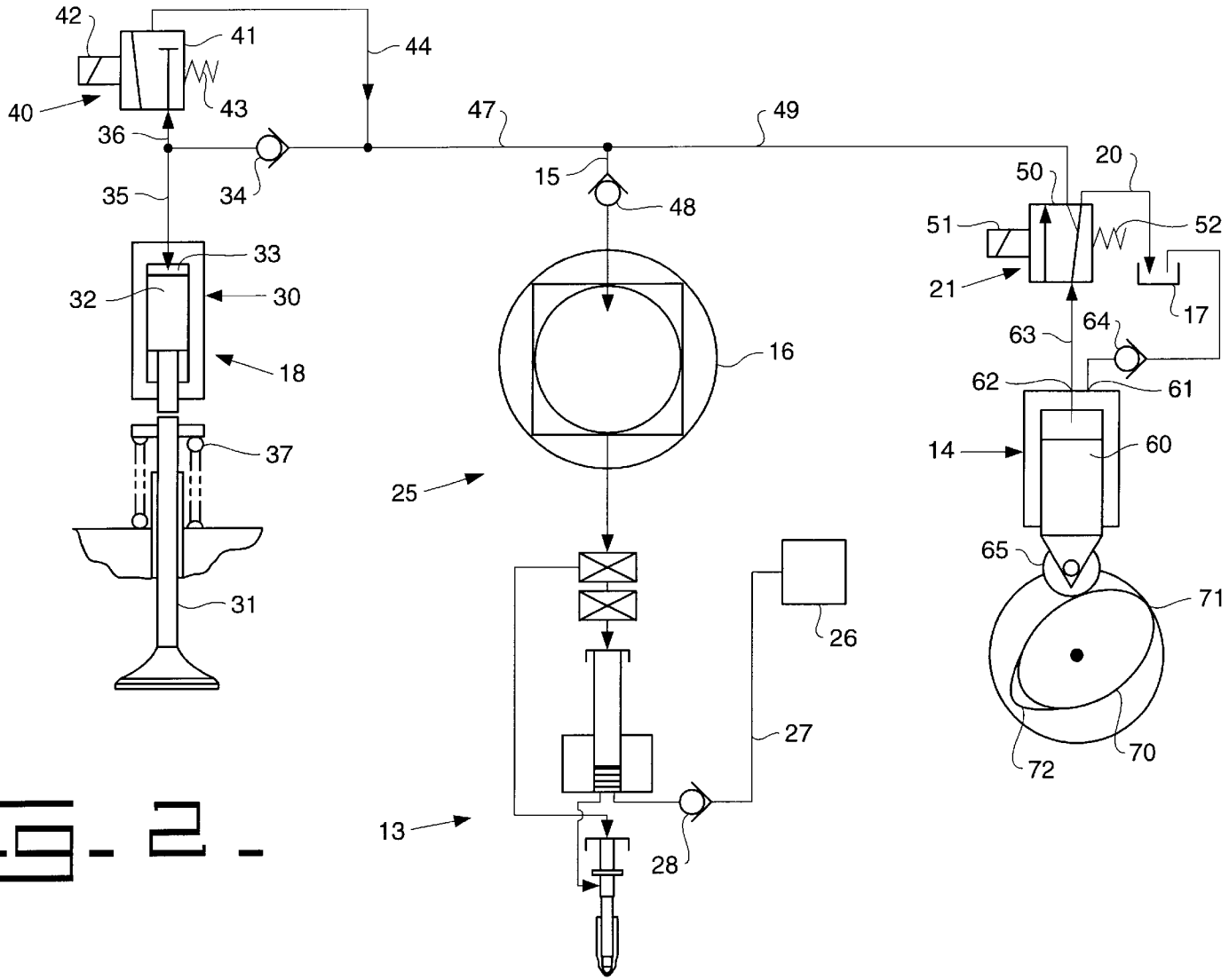
FIG. 2 is a diagrammatic representation of a hydraulic system according to the present invention.

In the embodiment of the present invention illustrated in FIG. 1, each cylinder 12*a–f* is provided with one pump 14*a–f*, one injector 13*a–f*, one exhaust valve 18*a–f*, and one intake valve 19*a–f*. Each pump 14*a–f* is fluidly connected to a pump outlet line 63*a–f* that can be alternately opened or closed to a low pressure return line 20*a–f* by a plurality of timing valves 21*a–f*. In order to avoid confusion by making the drawings overly complex, some features are not shown. For instance, valves 21*b–e* and their external plumbing are not shown. When a timing valve 21*a–f* opens one of the pump outlet lines 63*a–f* to a low pressure return line 20*a–f*, fluid displaced by pumps 14*a–f* can flow to a low pressure drain 17, which can be the engine's oil pan. When a timing valve 21*a–f* closes fluid communication between a pump outlet line 63*a–f* and a low pressure return line 20*a–f*, the pump outlet line 63*a–f* becomes fluidly connected to a shared fluid transfer line 49*a–f*. The shared fluid transfer line 49*a–f* branches into a supply line 15*a–f* and a fluid transfer line 47*a–f*. Each supply line 15*a–f* fluidly connects to a high pressure rail 16. The other branches, fluid transfer lines 47*a–f*, are connected directly to exhaust valves 18*a–f* (FIG. 2 embodiment). In an alternative embodiment (see FIG. 3 embodiment), fluid transfer lines 47*a–f* are fluidly connected via a switching valve 80*a–f* to either the exhaust valves 18*a–f* or the intake valves 19*a–f*.

Referring to FIG. 2, there is shown a diagrammatic representation of a hydraulic system 25 according to the present invention. Those skilled in the art will appreciate that each cylinder in FIG. 1 will preferably have a hydraulic system 25, except that one or more high pressure rails 16 are shared by several cylinders. Hydraulic system 25 includes an exhaust valve 18, a drain valve 40, a timing valve 21, a pump 14, a high pressure rail 16 and a hydraulically actuated fuel injector 13. A cam 70 is provided that is coupled directly to the engine crankshaft (not shown) and preferably rotates at full engine speed. In this embodiment, cam 70 has two lobes, an exhaust lobe 71 and an engine brake lobe 72. In the preferred embodiment, the size of exhaust lobe 71 is greater than the size of engine brake lobe 72 so that exhaust valve 18 opens farther during an exhaust mode and less during an engine braking event. Pump 14 includes a pump piston 60 which is attached to a cam follower 65. As cam 70 rotates, lobes 71 and 72 alternately lift cam follower 65, moving pump piston 60 in accordance with the cam profile. As either lobe moves piston 60 toward pump 14, it displaces hydraulic fluid within pump 14 relative to its travel distance.

Pump 14 has a pump outlet 62 which connects to a pump outlet line 63. A timing valve 21 is provided which has a valve member 50 that is movable between an off position, as shown, and an on position. A biasing spring 52 biases valve member 50 toward its off position, in which it provides fluid communication between pump outlet line 63 and a low pressure return line 20 that connects to a low pressure drain 17. In its off position, valve member 50 also provides fluid communication between a shared fluid transfer line 49 and low pressure return line 20. Low pressure drain 17 fluidly connects to pump 14 via a pump inlet 61 to return hydraulic fluid to piston 60. A check valve 64 is positioned between low pressure drain 17 and pump inlet 61 such that fluid can flow from low pressure drain 17 to pump 14, but not the reverse.

Timing valve 21 can be moved to its on position by an electrical actuator 51 which is preferably a solenoid but could be any suitable actuator, such as a piezoelectric actuator. In its on position, valve member 50 fluidly connects pump outlet line 63 to shared fluid transfer line 49, but blocks fluid communication with return line 20. Thus, by moving timing valve 21, the pressure in shared fluid transfer line 49 can be varied to correspond with the action of pump 14. If timing valve 21 is opened when the relatively larger lobe 71 is acting on cam follower 65, the volume of fluid supplied to shared fluid transfer line 49 is relatively great. If timing valve 21 is opened when the relatively smaller lobe 72 is acting on cam follower 65, the fluid volume is relatively less. When the center of either lobe 71 or 72 has passed over cam follower 65, the pressure supplied from pump 14 will decrease according to the cam profile.

As previously described, shared fluid transfer line 49 branches into fluid transfer line 47 and supply line 15. A check valve 48 is positioned within supply line 15 and allows fluid flow to common rail 16 when the pressure in supply line 15 exceeds the rail pressure, but prevents fluid from being forced back into supply line 15 from common rail 16. Common rail 16 is fluidly connected to a plurality of hydraulically actuated fuel injectors 13*a–f*, and supplies the pressurized fluid for injector actuation. Fuel injector 13 is preferably a hydraulically actuated electronically controlled unit injector with a direct control needle, such as that taught in U.S. Pat. No. 5,669,355 to Gibson et al. A source of low pressure fuel 26 is provided which connects to injector 13 via a fuel supply line 27. Fuel is preferably pressurized for injection in injector 13 by exposing an intensifier piston within injector 13 to the high pressure fluid from common rail 16. In the preferred embodiment, common rail 16 contains a hydraulic fluid such as engine lubricating oil, that is different than fuel, although it should be appreciated that fuel or some other suitable engine fluid such as transmission, coolant, brake, or power steering might be substituted as the system hydraulic fluid. A check valve 28 is positioned in supply line 27 and allows fuel to flow from fuel supply 26 to injector 13, but prevents pressurized fuel from being forced back into fuel supply 26 when the fuel is pressurized in injector 13 prior to or during injection.

The second branch of shared fluid transfer line 49 is a fluid transfer line 47, in which a check valve 34 is positioned. Line 47 branches into a second fluid transfer line 35 and a drain line 36. Fluid transfer line 35 connects to a gas exchange valve actuator 30. Actuator 30 includes a piston 32 which is exposed to fluid pressure from second fluid transfer line 35 in a pressure chamber 33. Piston 32 is operably coupled to an exhaust valve member 31. A biasing spring 37 biases valve member 31 toward an up position in which it closes exhaust valve 18.

In the preferred embodiment, the fluid pressure necessary to overcome the force of biasing spring 37 and move valve member 31 down to open exhaust valve 18 can be provided by the fluid displacement induced in pump 14 by the action of either lobe 71 or 72 on cam follower 65. The pressure necessary to move piston 32 downward is preferably less than rail pressure so that all fluid directed into line 49 by pump 14 goes to actuator 30 until piston 32 contacts its stop. It should be appreciated that the sizes and strengths of the various system components should be such that the fluid displaced by engine brake lobe 72 moves valve member 31 a lesser distance than the fluid displaced by exhaust brake lobe 71. For example, the relative size of engine brake lobe 72, the strength of biasing spring 37, and the relative area of pressure surface 32 are preferably such that valve member 31 does not move its maximum potential distance when engine brake lobe 72 acts on pump piston 60. This strategy avoids the possibility of collision between valve member 31 and the engine piston near top dead center when valve 18 is open, as during an engine braking event. Similarly, the relative size of exhaust brake lobe 71, the strength of biasing spring 37, and the relative area of piston 32 that is exposed to fluid pressure in pressure chamber 33, should be such that valve member 31 is forced down against its stop when the relatively large lobe 71 acts on pump piston 60.

When valve member 31 reaches its stop, pressure in the system can build until it exceeds the fluid pressure in common rail 16, allowing fluid to be forced past check valve 48 into common rail 16 to maintain pressure and replenish fluid in the same. If rail pressure is at or above its desired pressure, timing valve 21 is deactivated so that the remaining pumping stroke of pump 14 is routed to low pressure reservoir 17. In this manner, pressurized fluid can be supplied to common rail 16 when timing valve 21 is fully opened during the action of exhaust lobe 71 on pump piston 60. When the relatively smaller engine brake lobe 72 acts on pump piston 60, the correspondingly smaller amount of fluid displaced should be insufficient to move exhaust valve member 31 all the way to its stop. Consequently, pressure in the system does not surpass the fluid pressure in common rail 16, and check valve 48 is not opened.

Drain line 36 connects to a drain valve 40 that includes a drain valve member 41 which is movable between an open and a closed position. Valve member 41 is biased toward its closed position with a biasing spring 43. When valve member 41 is moved to its open position by electrical actuator 42, it provides fluid communication between drain line 36 and a bypass line 44 which fluidly connects to fluid transfer line 47. When exhaust valve 18 has been open for the desired length of time, electrical actuator 42 can be energized to move valve member 41 to its open position, allowing fluid to drain through bypass line 44 as valve member 31 is returned to its up position by the action of biasing spring 37. However, those skilled in the art will recognize that this will occur if timing valve 21 is in its off position as shown so that fluid lines 47 and 49 are connected to low pressure reservoir 17. Alternatively, valve 21 could be in its on position such that fluid is evacuated from actuator 30 according to the retraction rate of piston 60, which follows cam 70. Another alternative might be to connect bypass line 44 directly to low pressure reservoir 17.

Figure 3:
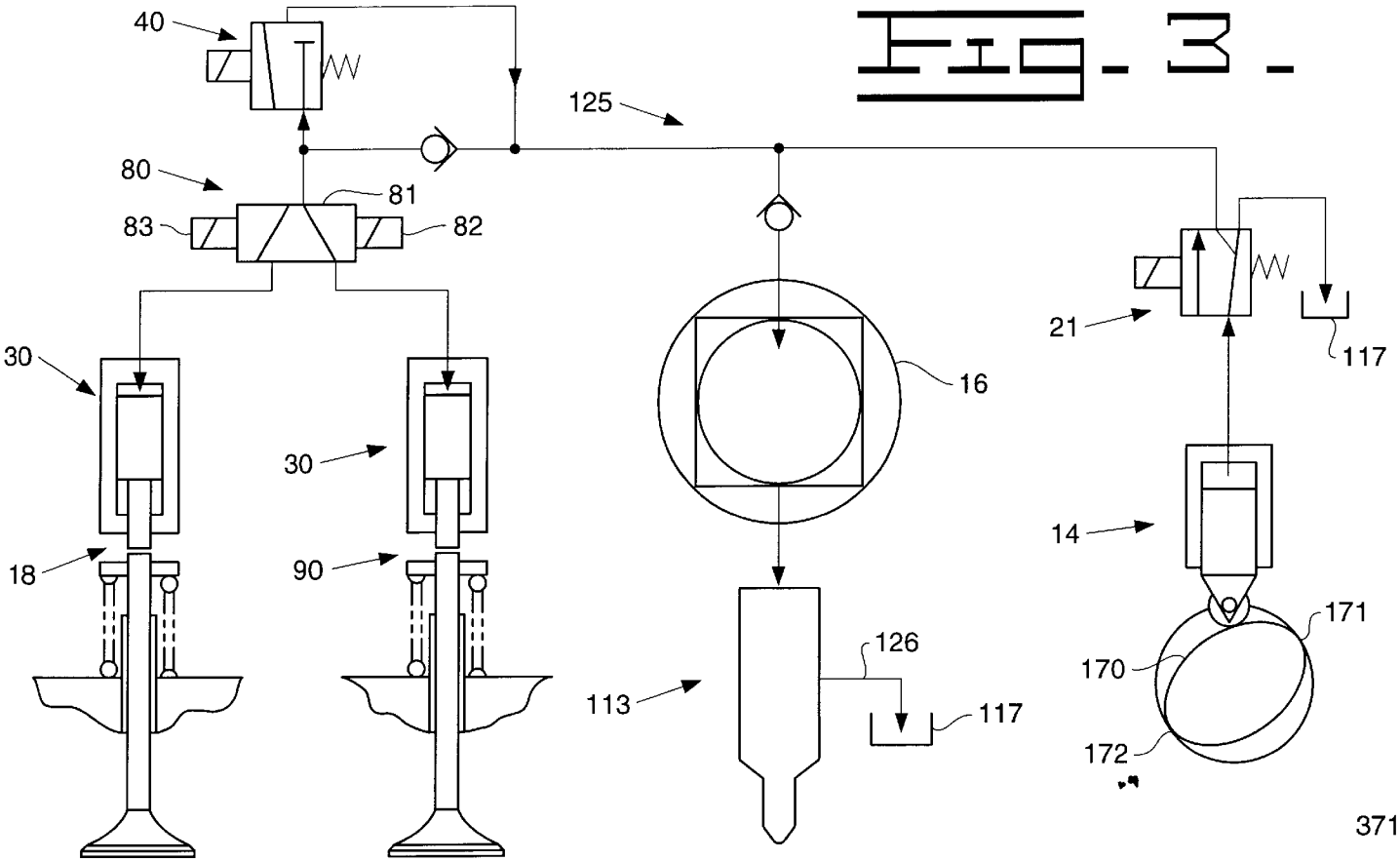
FIG. 3 is a diagrammatic representation of a second hydraulic system according to the present invention.

Referring to FIG. 3, there is shown a diagrammatic representation of a second hydraulic system 125 according to the present invention. While system 25 of FIG. 2 was primarily concerned with exhaust and engine braking, system 125 of FIG. 3 is concerned with control of intake and exhaust valves without engine braking. System 125 differs in that fuel is used as both the hydraulic actuation fluid and the injection fluid. Hydraulic system 125 includes a cam 170 and pump 14. Identical numbers are used to identify features that could be identical in both systems. A timing valve 21 determines whether pressurized fluid is supplied to hydraulic system 125 or merely displaced at low pressure back to reservoir 17. Hydraulic system 125 includes a fuel injector 113 which is fluidly connected to a common rail 16. In this embodiment, injector 113 could be a pressure intensified injector with a direct control needle, such as a Bosch injector of the type described in "Heavy Duty Diesel Engines—The Potential of Injection Rate Shaping for Optimizing Emissions and Fuel Consumption", presented by Messrs. Bemd Mahr, Manfred Durnholz, Wilhelm Polach, and Hermann Grieshaber, Robert Bosch GmbH, Stuttgart, Germany, at the 21$^{st}$ International Engine Symposium, May 4–5, 2000, Vienna, Austria.

An exhaust valve 18 and an intake valve 90 are also provided which can be actuated with hydraulic actuators 30 in a manner similar to the valve described from FIG. 2. A switching valve 80 is included that has a valve member 81 which is movable between a first and a second position. In switching valve 80's first position, it allows the fluid displaced by pump 14 to be supplied to intake valve 90. In its second position, fluid from pump 14 can be supplied to exhaust valve 18. In the preferred embodiment, two electrical actuators 82 and 83 are utilized to move switching valve 81 between its respective positions. Hydraulic system 125 also includes a drain valve 40 which functions in a manner similar to the drain valve described with respect to the embodiment of the present invention from FIG. 2.

Those skilled in the art will appreciate that the present invention could use either oil or fuel as the hydraulic fluid. Due at least in part to differences in fluid viscosity, however, various differences would exist between an embodiment of the present invention that uses oil and one that uses fuel. For example, a different fuel injector would be used for an oil system than a fuel system. Similarly, an oil system might use different plumbing designs and valve types than a fuel system.

Figure 4:
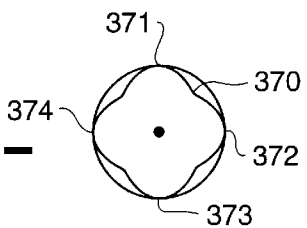
FIG. 4 is an engine cam according to an embodiment of the present invention for boosted engine braking applications.

Referring to FIG. 4, there is shown a cam 370 from a third embodiment of the present invention. Cam 370 has four lobes and preferably rotates at one half engine speed in a four cycle engine. As cam 370 rotates, each lobe engages a cam follower to initiate fluid displacement by pump 14. Lobe 371 is an exhaust lobe which acts on pump 14 to displace fluid for actuation of exhaust valve 18. Lobe 372 is an intake lobe which acts on pump 14 to displace fluid for actuation of intake valve 90. Lobes 373 and 374 are an engine brake boost lobe and engine brake lobe, respectively. During engine braking and boosted engine braking, the exhaust and intake valves must be actuated more frequently and at different times than during normal engine operation.

In an engine braking event, fuel injection is terminated. On each down stroke, air is drawn into the engine cylinder through an intake valve. Preferably prior to the piston reversing its direction at bottom dead center, the intake valve is closed, forcing the piston to compress air once it passes its bottom dead center position and begins to move toward top dead center. When the piston has neared top dead center, an exhaust valve or a separate braking valve is opened for blow down, releasing the pressurized air. During a boosted engine braking event, the exhaust valve is opened briefly near bottom dead center to boost the initial pressure in they cylinder from the relatively higher pressure in the exhaust line. This is accomplished with the engine brake boost lobe. By forcing pressurized air into the boosted cylinder, more engine energy is required to move the piston toward top dead center, resulting in a greater retarding torque on the engine. During normal four cycle engine operation, timing valve 21 remains closed while engine brake boost lobe 373 and engine brake lobe 374 act on pump 14 to pressurize fluid. However, when engine braking or boosted engine braking is desired, timing valve 21 can be opened to supply fluid for actuation of exhaust valve 18 as desired.

Figure 5:
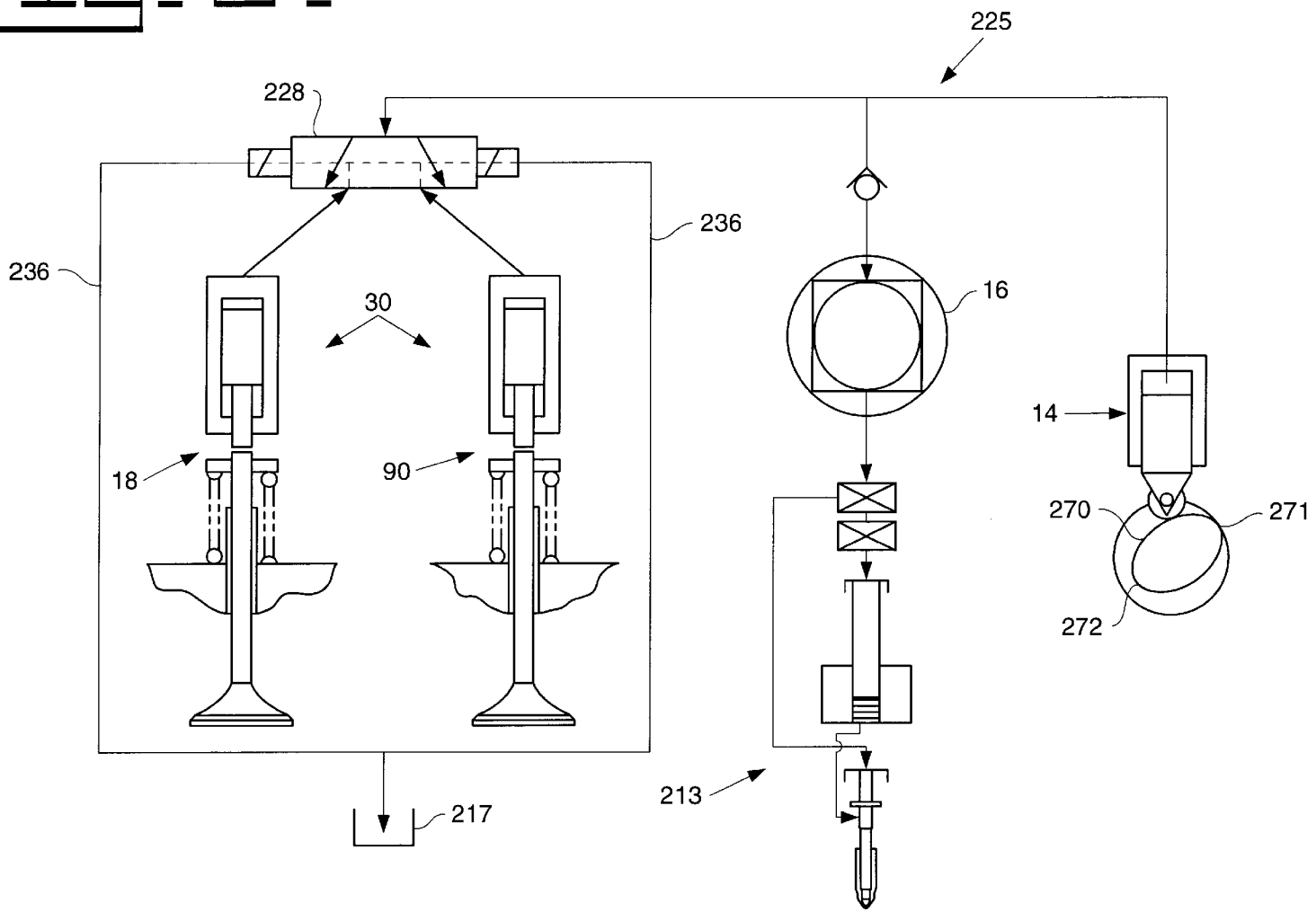
FIG. 5 is a diagrammatic representation of a third hydraulic system according to the present invention.

Referring to FIG. 5, there is shown a diagrammatic representation of a third hydraulic system 225 according to the present invention. System 225 is similar to system 125 of FIG. 3, in that system 225 is concerned with control of intake and exhaust valves. Identical numbers are used to identify features that could be identical in both systems. System 225 differs from system 125 in that the functions of switching valve 80, timing valve 21, drain valve 40, and check valve 34 have been replaced with a single linear control valve 228. Linear control valve 228 allows the fluid displaced by pump 14 to be supplied to either exhaust valve 18 or intake valve 90 contained within hydraulic system 225. Therefore, linear control valve 228 is used to actuate both the exhaust valve 18 and the intake valve 90. Both valves can be actuated with hydraulic actuators 30 in a manner similar to the valve described from FIG. 2. Hydraulic system 225 includes a fuel injector 213, which is fluidly connected to a common rail 16. Injector 213 could be a pressure intensified injector with a direct control needle like the fuel injector described in FIG. 3. Those skilled in the art will recognize that other common rail fuel injectors could be used with the present invention. For instance, a fuel injector like that of FIG. 3, except using fuel as the needle control fluid instead of oil could be substituted. In addition, with modest modifications, the so called Bosch Amplifier Piston Common Rail System fuel injector could also be used with the present invention.

Figure 6:
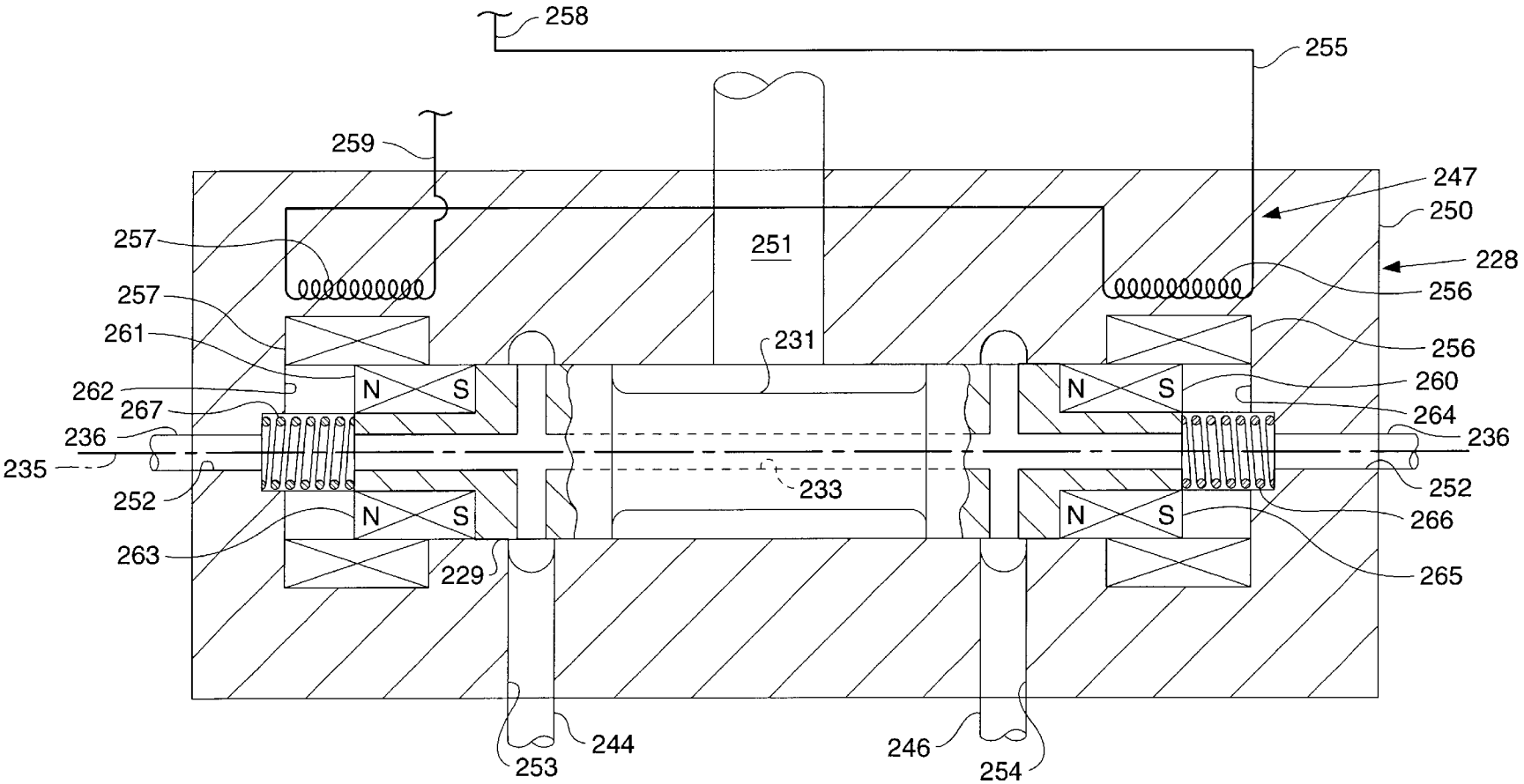
FIG. 6 is a sectioned view of a three position linear control valve as shown in FIG. 5.

Referring to FIG. 6, there is shown a sectioned view through linear control valve 228 that was shown in the FIG. 5. Linear control valve 228 is shown as fluidly connected to exhaust valve 18 via exhaust control line 244 and intake valve 90 via intake control line 246. Linear control valve 228 includes a valve body 250 and a movable spool valve member 229. Spool valve member 229 defines an internal passage 233 and an annulus 231. Spool valve member 229 is movable along its centerline 235 between a first position, a second or middle position (as shown), and a third position. Valve body 250 defines supply passage 251 that is fluidly connected to pump 14. Depending on the linear position of spool valve member 229 within valve body 250, supply passage 251 can be fluidly connected to either first device passage 253 or second device passage 254, all defined by valve body 250. However, supply passage 251 preferably cannot be fluidly connected to both first device passage 253 and second device passage 254 simultaneously. Linear control valve 228 also includes a drain passage 252 that is fluidly connected to low pressure actuation fluid reservoir 217 via drain line 236. Spool valve member 229 is biased to its second position by first biasing spring 266 and second biasing spring 267, which are positioned in contact with opposite ends of spool valve member 229. When spool valve member 229 is in its second position as shown, first device passage 253 and second device passage 254 are fluidly connected to drain passage 251 via internal passage 233 of spool valve member 229. When spool valve member 229 is in its second position, first stop surface 263 and second stop surface 265 of spool valve member 229 are out of contact with valve body 250.

Linear control valve 228 has an electrical actuator 247 that includes a first solenoid coil 256 and a second solenoid coil 257, both mounted in valve body 250 adjacent opposite ends of spool valve member 229 and wound in opposite directions. Electrical actuator 247 also includes first permanent magnet 260 and second permanent magnet 261, both attached to opposite ends of spool valve member 229. First solenoid coil 256 is adjacent first permanent magnet 260, and second solenoid coil 257 is adjacent second permanent magnet 261. While both solenoid coils 256 and 257 are wound in opposite directions, the polarity of both permanent magnets are oriented in the same direction.

In the preferred embodiment of FIG. 6, first solenoid coil 256 and second solenoid coil 257 are parts of the same electrical circuit 255, but are wound in opposite directions. When a voltage is applied across first terminal 258 and second terminal 259, both solenoid coils are energized, but first solenoid coil 256 will repel first permanent magnet 260 while the oppositely wound second solenoid coil 257 will attract second permanent magnet 261, causing spool valve member 229 to move to the left along its centerline 235 to its first position against the action of second biasing spring 267. When spool valve member 229 is in its first position resting against first stop 262, first stop surface 263 of spool valve member 229 is in contact with valve body 250. Supply passage 251 is fluidly connected to first device passage 253, while second device passage 254 remains fluidly connected to drain passage 252. When electrical current flows in the reverse direction across first terminal 258 and second terminal 259, again both solenoid coils are energized, but first solenoid coil 256 will attract first permanent magnet 260 while second solenoid coil 257 will repel second permanent magnet 261, causing spool valve member 229 to move to the right along its centerline 235 to its third position against the action of first biasing spring 266. When spool valve member 229 is in its third position resting against second stop 264, second stop surface 265 of spool valve member 229 is in contact with valve body 250. Supply passage 251 is fluidly connected to second device passage 254, and drain passage 252 is fluidly connected to first device passage 253. Unlike conventional electrical actuators in which one energized solenoid coil creates an electromagnetic field that attracts an armature in order to move a valve member, this preferred embodiment allows two oppositely oriented solenoid coils to both push and pull simultaneously on permanent magnets to move the spool valve member 229 with a substantially higher magnetic force. When the electrical actuator 247 is de-engerized, spool valve member 229 moves toward and comes to rest in its second or middle position as shown.

It should be appreciated, however, that controlling the movement of spool valve member 229 along its centerline 235 could also be accomplished by placing first solenoid coil 256 and second solenoid coil 257 on different electrical circuits and by attaching conventional armatures rather than permanent magnets to the opposite ends of spool valve member 229. Electrical current could be applied to the electrical circuit including a first solenoid coil, so that only the first solenoid coil would be energized and pull the adjacent conventional armature against second stop 264, causing spool valve member 229 to move to its third position against the action of first biasing spring 266. Electrical current could be applied to the second electrical circuit that energizes a second solenoid coil to attract the adjacent conventional armature against first stop 262, causing spool valve member 229 to move to its first position against the action of second biasing spring 267. When neither coil is energized, spool valve member will move toward its middle position under the action of biasing springs 266 and 267.

In yet another alternative that would perform identical to the previous alternative and utilize conventional armatures, both first solenoid coil 256 and second solenoid coil 257 could be provided in the same electrical circuit, however, diodes could be positioned in the circuit to prevent current from flowing through both first solenoid coil and second solenoid coil simultaneously. When current is supplied in one direction, the diodes could permit current to flow to one of the solenoid coils but not the other, causing the conventional armature attached to the spool valve member 229 to pull toward the energized solenoid coil against the action of the biasing spring. Upon reversal of the current, the diodes could permit the current to flow to the other of the two solenoid coils, causing the conventional armature attached to spool valve member 229 to pull the other direction against the action of the other biasing spring. Again, unlike the preferred embodiment, there would be no simultaneous pushing and pulling on spool valve member 229.

Industrial Applicability

Referring again to FIG. 2, during normal four cycle engine operation exhaust valve 18 is opened during the engine exhaust stroke, and closed during the intake, compression and power strokes. When engine braking is desired, exhaust valve 18 is closed during the compression stroke, then opened to allow blow down near top dead center, and finally closed again some time after the piston passes top dead center. Cam 70 is preferably rotating at full engine speed, and the time at which the center of each of its lobes reaches cam follower 65 preferably corresponds to the maximum fluid displacement that the lobe can induce in pump 14. Because of the relative sizing of the cam lobes, and the linkage between the position of cam 70 and the engine crankshaft angle, there is a window of time during which each lobe displaces enough fluid to actuate exhaust valve 18.

As cam 70 rotates, the center of exhaust lobe 71 preferably passes cam follower 65 some time before the piston reaches bottom dead center, prior to the piston exhaust stroke. Similarly, the center of engine brake lobe 72 passes cam follower 65 as the piston approaches top dead center. By energizing electrical actuator 51 to open timing valve 21, fluid displaced by the cam lobes can be used to open valve 18 at any point during these two windows of time. By providing two relatively long windows of time in which valve 18 can be opened, the present invention allows great control over the timing of gas exchange, during both normal engine operation and engine braking.

During normal four cycle operation, exhaust lobe 71 begins to act on pump 14 as the engine piston moves toward bottom dead center during an intake stroke. As the piston nears bottom dead center, the fluid displaced by pump 14 reaches a level sufficient to actuate exhaust valve 18, representing the beginning of the window of time in which exhaust valve 18 can be actuated. Shortly before the desired time for opening of valve 18 is reached, electrical actuator 51 is energized, moving timing valve 21 to its on position. When timing valve 21 is thus opened, the fluid displaced by pump 14 can flow to pressure chamber 33 in valve actuator 30. When a sufficient pressure in chamber 33 is reached, piston 32 begins to move down, acting on valve member 31 to open exhaust valve 18. Because check valve 34 is a one way valve, once fluid flows through it the fluid cannot drain back into fluid transfer line 47. Consequently, once valve 18 is opened, it cannot close until drain valve 40 is opened to allow fluid to drain from pressure chamber 33.

Valve member 31 moves down until it reaches its stop. Because the fluid volume displaced by lobe 71 is preferably greater than that necessary to move valve member 31 against its stop, the pressure in chamber 33 and the rest of the system begins to rise. When the pressure in supply passage 15 exceeds the pressure in common rail 16, fluid flows past check valve 48 to replenish the fluid supply in common rail 16. Thus, pump 14 opens exhaust valve 18 and replenishes pressure in common rail 16. When sufficient fluid pressure has been communicated to common rail 16, timing valve 21 is de-energized, shutting of the flow of fluid from pump 14. This preferably occurs while exhaust lobe 71 is still pushing on pump piston 60, before pump piston 60 has begun to retract. Consequently, the additional fluid displaced by pump 14 flows via timing valve member 50 into low pressure return line 20, and back to the low pressure drain 17.

As the engine piston continues past its bottom dead center position, it begins to move back toward top dead center, expelling exhaust gases. When exhaust valve 18 has been open for the desired amount of time, drain valve 40 is actuated, allowing return spring 37 to move valve member 31 back toward its up position, closing exhaust valve 18. The fluid displaced by piston 32 as valve member 31 moves up flows through drain valve member 41 to bypass line 44, from where it can drain to fluid transfer line 47, ultimately flowing back toward the low pressure reservoir 17 by way of timing valve member 50. After exhaust valve 18 is closed, an intake valve (not shown in FIG. 2 embodiment) can be opened, allowing air to be drawn into the cylinder as the engine piston begins to move back toward bottom dead center.

During the subsequent compression and power strokes, exhaust valve 18 remains closed. As the piston approaches top dead center, fuel injector 13 is actuated with pressurized fluid from the common rail. The fuel ignites, and the piston is driven once again toward bottom dead center. At the desired time, exhaust valve 18 can be actuated in the manner described above to allow another exhaust stroke.

When engine braking is desired, fuel injection ceases. An intake valve (not shown) allows air to be drawn into the cylinder as the piston moves toward bottom dead center. In contrast to normal engine operation, valve 18 is not opened when the piston is near bottom dead center, forcing the piston to compress air as it moves back toward top dead center, supplying the desired retarding torque on the engine. As the piston nears top dead center, engine brake lobe 72 displaces sufficient fluid in pump 14 to actuate valve 18. Timing valve 21 can be thus be opened shortly before opening of valve 18 for blow down is desired. Because the relative size of engine brake lobe 72 is less than exhaust lobe 71, valve member 31 is moved a correspondingly lesser distance during engine braking. This is desirable because lesser travel distance of valve member 31 allows valve 18 to be opened and closed more quickly, and also lessens the risk of collision of valve member 31 and the piston. Shortly before exhaust valve 18 has been open for the desired amount of time, drain valve 40 can be actuated to allow valve member 18 to be moved upward by return spring 37, draining fluid from chamber 33 back to the low pressure drain 17.

Referring to FIG. 3, cam 170 is shown in the position it would occupy just after the engine piston has passed its bottom dead center position. Timing valve 21 is in its off position, drain valve 40 is closed, and switching valve 80 fluidly connects intake valve 90 to the fluid source. As the piston moves toward top dead center, cam 170 rotates allowing lobe 172 to act on pump 14 to displace fluid, creating a window of time in which intake valve 90 can be actuated. Shortly before the desired time for initiation of air intake, timing valve 21 can be moved to its on position, allowing the fluid displaced by lobe 172 to be communicated to hydraulic actuator 30. Hydraulic actuator 30 will thus push valve 90 open, allowing air to be drawn into the cylinder as the piston moves toward bottom dead center.

The fluid displaced by lobes 171 and 172 is preferably greater than that necessary to open valves 18 and 90 completely, allowing the valve members to move until they reach a stop. In a manner similar to that described with respect to the embodiment from FIG. 2, the fluid displaced by the action of lobes 171 and 172 can replenish the supply of fluid in the common rail 16. When the pressure in common rail 16 has been restored to the desired level, timing valve 21 can be deactivated, shutting off the supply of fluid to common rail 16.

Shortly before the desired amount of air has been drawn into the cylinder, drain valve 40 is moved to its open position, allowing intake valve 90 to close in a manner similar to that described with regard to FIG. 2. After intake valve 90 has closed, electrical actuator 82 should be energized, moving valve member 81 to allow fluid communication with hydraulic actuator 30 of exhaust valve 18. As the piston once again nears bottom dead center, timing valve 21 preferably remains in its off position, allowing the piston to continue back toward top dead center, constituting the engine compression stroke. When the preferred time for fuel injection occurs, injector 113 is actuated to inject fuel into the cylinder. The fuel ignites, forcing the piston back toward bottom dead center, constituting the engine's power stroke. Shortly before the power stroke is completed, and venting of exhaust is desired, timing valve 21 is moved to its on position, supplying fluid to hydraulic actuator 30 of valve 18 via switching valve 80. The fluid displaced by exhaust lobe 171 opens exhaust valve 18 and allows the piston to expel burned exhaust gases from the cylinder. When exhaust valve 18 has been open for the desired amount of time, drain valve 40 can be moved to its open position, allowing the fluid displaced by the closing of the valve to drain back into the low pressure drain 17.

Referring to FIG. 4, there is shown a four lobed cam 370 for use in applications of the present hydraulic system 125 to conventional and boosted engine braking, as well as normal four cycle engine operation. During normal four cycle engine operation, cam 370 functions in a manner similar to that described with respect to cam 170 from FIG. 3. Exhaust lobe 371 displaces fluid for actuation of exhaust valve 18, which preferably occurs when the engine piston is near bottom dead center. Similarly, intake lobe 372 displaces fluid that can be used to actuate intake valve 90, which preferably occurs when the engine piston is near top dead center. Engine brake boost lobe 373 preferably comes around near bottom dead center before the compression stroke. This allows for the opportunity to briefly open exhaust valve 18 near piston bottom dead center to increase the initial pressure in the cylinder to increase braking horsepower. The engine brake lobe 374 comes around thereafter when the piston approaches top dead center in a manner similar to lobe 72 in FIG. 2.

Referring to FIGS. 5–6, cam 270 is shown in the position it would occupy just after the engine piston has passed its bottom dead center position. During this same time, electrical current flows through first terminal 258 such that first solenoid coil 256 pulls and second solenoid 257 pushes spool valve member 229 along its center line 235 to its rightward third position against the action of first biasing spring 266. When spool valve member 229 is in this third position, exhaust control line 244 stays fluidly connected with low pressure fuel reservoir 117 via drain passage 252. Intake control line 246 becomes fluidly connected to high pressure fuel via second device passage 254. As the engine piston moves toward top dead center position, cam 270 rotates allowing lobe 272 to act on pump 14. Fluid displaced by lobe 272 is communicated to hydraulic actuator 30, which will push intake valve 90 open, allowing air to be drawn into the cylinder as the piston moves toward bottom dead center.

The fluid displaced by lobes 271 and 272 is preferably greater than that necessary to open valves 18 and 90 completely, allowing the valve members to move until they reach a stop. In a manner similar to that described with respect to the embodiment from FIG. 2, the fluid displaced by the action of lobes 271 and 272 can replenish the supply of fluid in the common rail 16. When the pressure in common rail 16 has been restored to the desired level, spool valve member 229 can be moved to its second position, returning the system pressure below the fluid pressure in common rail 16.

Shortly before the desired amount of air has been drawn into the cylinder, first solenoid coil 256 and second solenoid coil 257 of linear control valve 228 can be de-energized causing spool valve member 229 to move along its center line 235 back to its second position under the action of first biasing spring 266 and second biasing spring 267. When spool valve member 229 is in its second position, second device passage 254 is fluidly connected to low pressure fuel reservoir 217, allowing intake valve 90 to close in a manner similar to that described with regard to FIG. 2. About the time that the intake valve 90 has closed, the piston begins its engine compression stroke by continuing toward top dead center. When the preferred time for fuel injection occurs, injector 213 is actuated to inject fuel into the cylinder. The fuel ignites, forcing the piston back toward bottom dead center, constituting the engine's power stroke. Shortly before the power stroke is completed, and venting of exhaust is desired, electrical current is supplied through second terminal 259 such that second solenoid coil 257 pulls and first solenoid coil 256 pushes spool valve member 229 along center line 235 to its leftward first position. Now, the fluid displaced by exhaust lobe 271 opens exhaust valve 18 and allows the piston to expel burned exhaust gases from the cylinder. When exhaust valve 18 has been open for the desired amount of time, spool valve member is moved to its second position, allowing the fluid displaced by the closing of the exhaust valve 18 to drain back into the low pressure reservoir 217. To repeat the injection process, spool valve member 229 once again moves toward its third position, allowing fuel intake valve 90 to be returned to fluid communication with pump 14.

The present invention represents an improvement over prior art engine hydraulic systems by allowing the timing of valve actuation to be determined relatively independently of engine speed and crank angle. Freeing the timing of valve and fuel injector actuation allows the optimization of combustion bum quality and a reduction in harmful emissions. Further, different operating conditions require versatility in the timing of gas exchange and fuel injection. For instance, during engine compression release braking it is desirable to open and close the exhaust valves relatively quickly. At lower engine speeds or idle conditions, it may be desirable for the exhaust valves to remain open a relatively greater length of time. Finally, the system also efficiently maintains fluid pressure in a common rail used by the fuel injectors.

It should be appreciated that various modifications could be made to the present invention without departing from its intended scope. For example, the present timing valve-hydraulic actuator system might be applicable to fuel and oil rail injection systems. Also, various valve types such as pilot operated spools and/or poppet valves might be used. In addition, rather than draining used hydraulic fluid back into the fluid transfer lines, it might be drained directly back into the low pressure reservoir, into an accumulator or possibly even into the engine lubrication oil circuit. Other aspects and features of the present invention can be obtained from a study of the drawings, the disclosure, and the appended claims.

What is claimed is:

1. A hydraulic system comprising:

a pump with an outlet;

a low pressure drain;

a high pressure rail;

a fuel injector fluidly connected to said high pressure rail;

a gas exchange valve actuator;

a timing valve having an off position in which said outlet of said pump is fluidly connected to said low pressure drain, and an on position in which said outlet is fluidly connected to said gas exchange valve actuator; and a supply line fluidly connecting said output of said pump to said high pressure rail.

2. The hydraulic system of claim 1 including a plurality of pumps and a plurality of gas exchange valve actuators; and each of said plurality of gas exchange valve actuators being fluidly connected to one of said plurality of pumps.

3. The hydraulic system of claim 1 wherein said fuel injector is a hydraulically actuated fuel injector.

4. The hydraulic system of claim 3 wherein said fuel injector includes a fuel inlet connected to a source of fuel; and said high pressure rail contains a fluid that is different from fuel.

5. The hydraulic system of claim 1 including an exhaust valve operably connected to said gas exchange valve actuator.

6. The hydraulic system of claim 1 including a check valve fluidly positioned between said outlet of said pump and said high pressure rail, but a fluid connection between said outlet of said pump and said gas exchange valve actuator being free of said check valve.

7. The hydraulic system of claim 1 including a check valve fluidly positioned between said outlet of said pump and said gas exchange valve actuator, but a fluid connection between said outlet of said pump and said high pressure rail being free of said check valve.

8. The hydraulic system of claim 1 including a cam operably coupled to said pump;

said cam includes an exhaust lobe and at least one of an engine brake lobe and an intake lobe.

9. The hydraulic system of claim 1 wherein said gas exchange valve actuator includes a first gas exchange valve actuator operably connected to an exhaust valve, and a second gas exchange valve actuator operably connected to an intake valve.

10. The hydraulic system of claim 1 including a drain line fluidly connected to said gas exchange valve actuator; and a drain valve having an open position in which said drain line is open, and a closed position in which said drain line is closed.

11. A method of operating an engine, comprising the steps of:

opening a gas exchange valve at least in part by fluidly connecting a gas exchange valve actuator to an outlet of a pump at a first chosen time;

supplying fluid to a high pressure rail at least in part by fluidly connecting said outlet of said pump to said high pressure rail after said opening step; and injecting fuel at least in part by supplying fluid to a fuel injector from said high pressure rail at a second chosen time.

12. The method of claim 11 wherein said opening step includes a step of moving a timing valve from an off position to an on position.

13. The method of claim 12 wherein said moving step includes a step of activating an electrical actuator operably connected to said timing valve.

14. The method of claim 11 wherein said opening step is performed with fluid at a first pressure; and said supplying step is performed with said fluid at a second pressure that is greater than said first pressure.

15. The method of claim 11 wherein said injecting step includes a step of pressurizing fuel within said fuel injector at least in part by exposing an intensifier piston to fluid pressure in said high pressure rail.

16. The method of claim 15 wherein said pump is fluidly connected to a source of actuation fluid that is different from said fuel.

17. An engine comprising:

an engine casing defining a plurality of cylinders;

said engine casing having attached thereto a fuel injector, at least one gas exchange valve actuator, a pump, a supply line and timing valve for each of said plurality of cylinders;

a low pressure drain;

a high pressure rail; and each of said timing valves having an off position in which an outlet of said pump is fluidly connected to said low pressure drain, and an on position in which said outlet is fluidly connected to said gas exchange valve actuator.

18. The engine of claim 17 wherein each said fuel injector is fluidly connected to said high pressure reservoir.

19. The engine of claim 17 wherein each said supply line fluidly connects said output of one said pump to said high pressure rail; and said gas exchange valve actuator is fluidly connected to said supply line via fluid transfer line.

20. The hydraulic system of claim 1 wherein said pump and said gas exchange valve actuator are fluidly connected in series; and said pump, said high pressure rail and said fuel injector being fluidly connected in series.

* * * * *